US008579333B2

(12) United States Patent
Dyer et al.

(10) Patent No.: US 8,579,333 B2
(45) Date of Patent: Nov. 12, 2013

(54) CONFIDENTIAL POSTCARDS

(75) Inventors: Michael Clark Dyer, Trabuco Canyon, CA (US); Mark Anthony Costanzo, Richmond, VA (US)

(73) Assignee: R.R. Donnelley & Sons, Chicago, IL (US)

( * ) Notice: Subject to any disclaimer, the term of this patent is extended or adjusted under 35 U.S.C. 154(b) by 270 days.

(21) Appl. No.: 12/699,700

(22) Filed: Feb. 3, 2010

(65) Prior Publication Data

US 2010/0230477 A1 Sep. 16, 2010

Related U.S. Application Data

(60) Provisional application No. 61/154,799, filed on Feb. 24, 2009.

(51) Int. Cl.
*B42D 15/00* (2006.01)
*B65D 27/00* (2006.01)
*B65D 27/06* (2006.01)

(52) U.S. Cl.
USPC ..... 283/106; 283/901; 229/92.1; 229/92.8; 229/300

(58) Field of Classification Search
USPC ..... 283/98, 106, 901; 229/92.8, 92.1, 300
See application file for complete search history.

(56) References Cited

U.S. PATENT DOCUMENTS 661,690 A 11/1900 Forney
690,793 A 1/1902 Taylor
975,737 A 11/1910 Utley
1,032,648 A 7/1912 Berwick
1,044,123 A 11/1912 Berwick
1,472,142 A 10/1923 Shurick
1,698,628 A 1/1929 Gonzales (Continued)

FOREIGN PATENT DOCUMENTS

JP 200219335 5/1990
JP 2187396 7/1990
JP 6210984 8/1994
JP 11286187 10/1999

*Primary Examiner* — Kyle Grabowski
(74) *Attorney, Agent, or Firm* — Hanley, Flight and Zimmerman, LLC

(57) ABSTRACT

Confidential postcards are described herein. An example postcard mailer includes a substrate having a first panel and a second panel adjacent the first panel, wherein each of the first panel and the second panel includes a first face and a second face. The example mailer also includes a first line of weakness separating the first panel and the second panel and a first fastener pattern included on at least one of the first face of the first panel or the first face of the second panel to releasably adhere a first portion of the first face of the first panel to a first portion the first face of the second panel when the substrate is folded about the first line of weakness. In addition, the example mailer includes a second fastener pattern included on at least one of the first face of the first panel or the first face of the second panel to releasably adhere a second portion of the first face of the first panel to a second portion of the first face of the second panel. The second fastener pattern and at least a portion of the first fastener pattern define an area that is not visible when the first face of the first panel is releasably adhered to the first face of the second panel and a third portion of the first face of the first panel and a third portion of the second face of the second panel are separated from each other.

27 Claims, 6 Drawing Sheets

(56) References Cited

U.S. PATENT DOCUMENTS

| | | | | | |
|---|---|---|---|---|---|
| 2,396,221 | A | | 3/1946 | Yancey | |
| 2,983,431 | A | | 5/1961 | Turan | |
| 3,184,150 | A | | 5/1965 | Hubbard | |
| 3,228,586 | A | | 1/1966 | Hayes | |
| 3,507,519 | A | | 4/1970 | McNabb | |
| 3,977,597 | A | | 8/1976 | Wise | |
| 4,524,903 | A | | 6/1985 | Vath | |
| 4,575,121 | A | | 3/1986 | Conti | |
| 4,585,160 | A | | 4/1986 | Fiske | |
| 4,669,652 | A | | 6/1987 | Seguin | |
| 4,715,531 | A | | 12/1987 | Stewart et al. | |
| 4,799,618 | A | | 1/1989 | Jenkins | |
| 4,865,247 | A | | 9/1989 | Grabner | |
| 4,915,287 | A | | 4/1990 | Volk et al. | |
| 4,918,128 | A | | 4/1990 | Sakai | |
| 5,020,829 | A | | 6/1991 | Shibahara et al. | |
| 5,104,036 | A | | 4/1992 | Rutkowski et al. | |
| 5,125,562 | A | | 6/1992 | Bendel | |
| 5,174,491 | A | | 12/1992 | Taylor et al. | |
| 5,174,493 | A | | 12/1992 | File | |
| 5,201,464 | A | | 4/1993 | File | |
| 5,213,560 | A | | 5/1993 | Crowley | |
| 5,253,798 | A | | 10/1993 | Lombardo | |
| 5,289,972 | A | | 3/1994 | Sauerwine et al. | |
| 5,314,110 | A | | 5/1994 | Lombardo | |
| 5,346,123 | A | * | 9/1994 | Lombardo | 229/92.1 |
| 5,366,145 | A | | 11/1994 | Sauerwine | |
| 5,370,302 | A | | 12/1994 | Dyer | |
| 5,370,304 | A | | 12/1994 | Sauerwine et al. | |
| 5,375,764 | A | | 12/1994 | Sauerwine | |
| 5,376,048 | A | | 12/1994 | Whiteside | |
| 5,402,934 | A | | 4/1995 | Sauerwine | |
| 5,421,620 | A | | 6/1995 | Sauerwine | |
| 5,464,255 | A | | 11/1995 | Schildmeyer | |
| 5,482,753 | A | | 1/1996 | Langan et al. | |
| 5,513,795 | A | | 5/1996 | Sauerwine | |
| 5,553,774 | A | | 9/1996 | Goodno | |
| 5,595,404 | A | | 1/1997 | Skees | |
| 5,598,970 | A | | 2/1997 | Mudry et al. | |
| 5,603,529 | A | | 2/1997 | Breindel | |
| 5,622,390 | A | | 4/1997 | Jenkins | |
| 5,626,370 | A | | 5/1997 | Petkovsek | |
| 5,642,855 | A | | 7/1997 | Michlin | |
| 5,667,134 | A | | 9/1997 | Olson et al. | |
| 5,752,647 | A | | 5/1998 | Schubert et al. | |
| 5,785,242 | A | | 7/1998 | Lombardo | |
| 5,803,889 | A | | 9/1998 | Littman | |
| 5,829,670 | A | | 11/1998 | Lombardo et al. | |
| 5,862,978 | A | | 1/1999 | Forrest | |
| 5,901,903 | A | | 5/1999 | Sanders et al. | |
| 5,950,910 | A | | 9/1999 | Petkovsek | |
| 5,961,151 | A | | 10/1999 | Tung et al. | |
| 6,003,760 | A | | 12/1999 | Abercrombie | |
| 6,019,280 | A | | 2/2000 | Peterson | |
| 6,039,242 | A | | 3/2000 | Tee | |
| 6,047,880 | A | | 4/2000 | Petkovsek | |
| 6,123,253 | A | | 9/2000 | Mehta et al. | |
| 6,126,064 | A | * | 10/2000 | Hutchinson | 283/106 |
| 6,129,389 | A | | 10/2000 | Younger | |
| 6,135,506 | A | | 10/2000 | Chess et al. | |
| 6,179,202 | B1 | | 1/2001 | Alexander et al. | |
| 6,412,687 | B1 | | 7/2002 | Steitz | |
| 6,431,437 | B1 | | 8/2002 | Lombardo et al. | |
| 6,557,748 | B2 | | 5/2003 | Bethke | |
| 7,083,079 | B2 | | 8/2006 | Bethke | |
| 7,219,828 | B2 | | 5/2007 | Lombardo | |
| 7,530,488 | B2 | * | 5/2009 | Salerno et al. | 229/92.8 |
| 2005/0103830 | A1 | * | 5/2005 | Salerno et al. | 229/92.8 |
| 2006/0032896 | A1 | | 2/2006 | Bethke et al. | |
| 2007/0000978 | A1 | | 1/2007 | Bethke | |
| 2007/0235507 | A1 | | 10/2007 | Bethke | |

* cited by examiner

CONFIDENTIAL POSTCARDS

RELATED APPLICATION

This patent claims the benefit of the filing date of U.S. Provisional Application Ser. No. 61/154,799, filed Feb. 24, 2009, entitled "Confidential Postcards," and incorporated herein by reference in its entirety.

FIELD OF THE DISCLOSURE

The present disclosure relates generally to mailer forms and, more particularly, to confidential postcards.

BACKGROUND

Mailers come in a variety of different configurations and are commonly used for a variety of applications as an effective way to distribute information. Mailers in the form of postcards provide savings in postage charges. However, on Feb. 5, 2004, the United States Postal Service (USPS) revised Domestic Mail Manual (DMM) C100.2.9 to state that only the top or bottom of a double postcard, once folded, may be sealed and that the sealing of the sides of double postcards, regardless of method, is not permitted. Consequently, confidential information contained in a double postcard mailer would be plainly viewable.

DETAILED DESCRIPTION

Figure 1:
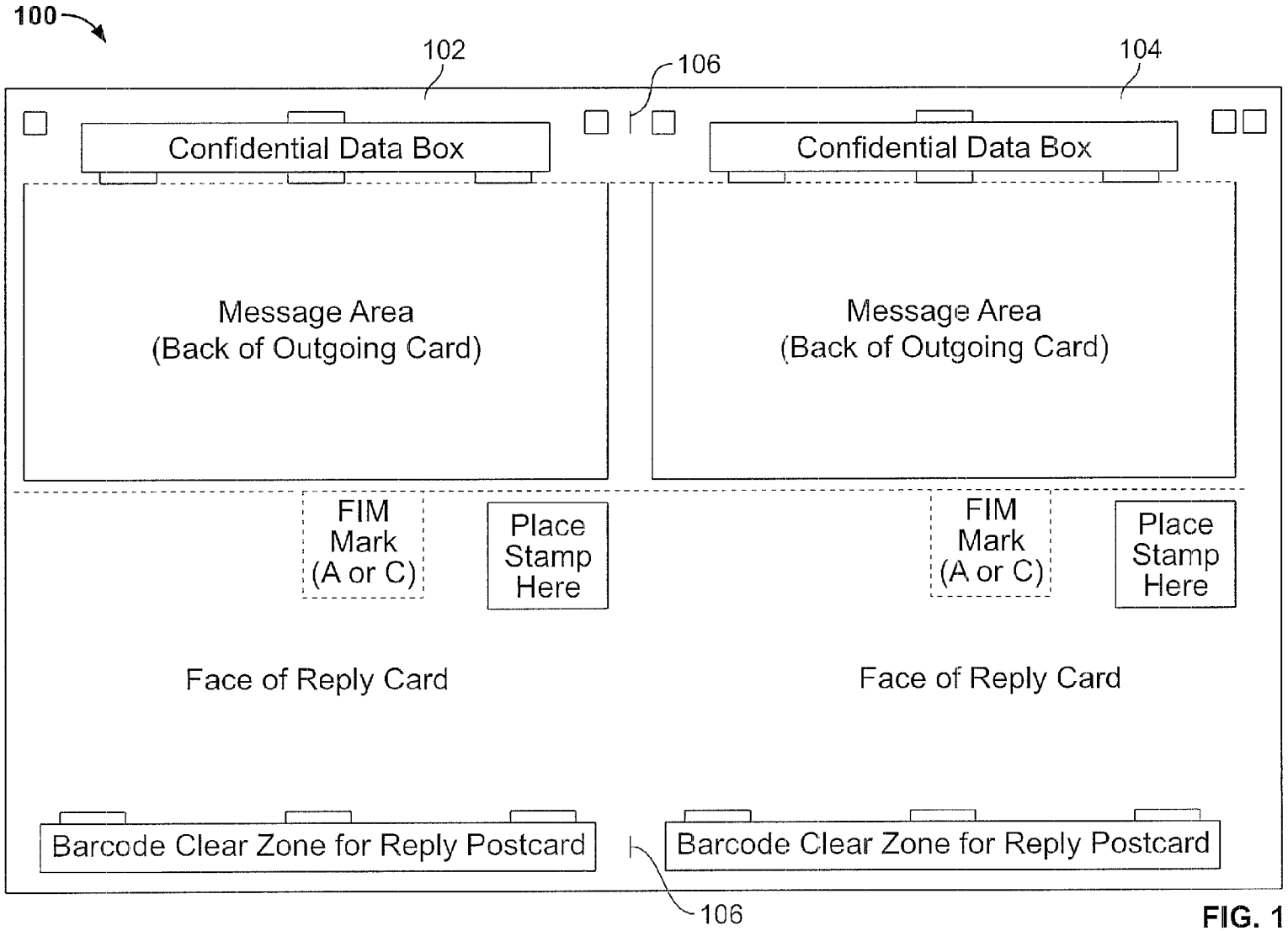
FIG. 1 is plan view of an example substrate having two example postcard forms, each used to form an example double postcard.

Postcards such as, for example, outgoing mailings and return postcards advantageously provide substantial savings in postage charges over conventional letters. For example, the current cost to mail a postcard via the USPS is less than mailing a regular letter. Such cost savings provide an incentive to utilize postcards for a wide variety of standard and/or specialized mailings.

However, postcards must meet certain USPS regulations. One such regulation requires postcard mailing pieces to meet particular weight (pounds per surface area) or thickness requirements. Further regulations require postcards to have a certain thickness, weight, and/or size so that the postcards can travel through postal sorters or other postal equipment without difficulties. For example, current USPS postcard regulations state that a postcard must have a height between 3.5 inches and 4.25 inches, a length between 5.0 inches and 6.0 inches, a thickness between 0.007 inches and 0.016 inches, and a weight of no more than 1 ounce. Thus, it is desirable for an outgoing mailer to qualify as a postcard to realize the postal mail savings for a first class postcard versus a first class letter. However, such requirements often limit the use of postcards. For example, the thickness requirement may limit the types of printers with which such postcards can be utilized, making the use of postcards more difficult and undesirable.

In addition, current USPS regulations state that the left and right sides of double postcards cannot be sealed. Consequently, all information contained on the interior panels of a double postcard would be plainly visible to any one who squeezed the folded double postcard to separate the interior panels to peek inside. If confidential information were contained on the postcard, this information would then be known to anyone who looked inside the postcard.

An example mailer form described herein has a return postcard integrally formed with the mailer such that when fully assembled, the return postcard satisfies the USPS regulations and requirements such as, for example, weight, thickness and size requirements. To meet USPS postcard thickness requirements without limiting the type of printer that can be used, the mailer form (e.g., a double V-fold mailer form) and, thus, the return postcard, are formed from a single sheet of paper or stock. The single sheet enables various or custom indicia such as, for example, personalized customer information, to be printed on a first or single side of the form via for example, a laser printer, a personal printer, an industrial printer, and/or any other suitable printer. In addition, the example postcard forms described herein contain confidential areas that are not plainly viewable by anyone without separating, substantially or completely, or fully opening the panels of the example postcard forms.

One of the example postcard or mailer forms described herein includes two panels, one of which serves as a return postcard (e.g., a business return postcard, a courtesy return postcard, etc.). In this example, at least one of a first face of a first panel and a first face of a second panel includes a first adhesive portion that receives adhesive to adhere the first panel and the second panel to form a postcard when the form is folded as an outgoing mailer. The first panel includes indicia related to the reply postcard, and the second panel may include, for example, instructions, advertisement information or any other information. A portion of at least one of the first panel or the second panel includes a second adhesive portion, apart or separate from the first adhesive portion. The second adhesive portion defines a confidential pocket or area in which confidential information may be included. The second adhesive portion couples the first and second panels so that the information contained in the confidential pocket is not viewable when the form is folded as an outgoing mailer.

The example configuration advantageously enables a user to print personalized data or information to a particular recipient onto the postcard and/or the confidential pocket or area either by printing on only one side of the form (e.g., where the form is a double V-fold type form) or on both sides of the form (e.g., where the form is a V-fold type form) when the form is fed through, for example, a laser printer. Such personalized or otherwise confidential information may include, for example, a recipient's name, account number, and/or other information on the form as detailed herein.

The information in the example mailer form may be human and/or machine readable information, which may be preprinted on the example form, printed on the form when the form is passed through a printer such as, for example, a laser printer, handwritten on the form, provided via a label, and/or any combination thereof.

Another example mailer form described herein includes four panels having an integral return postcard (e.g., a business return postcard, a courtesy return postcard, etc.) formed from two adjacent panels when the form is folded as an outgoing mailer. For instance, in one example, the mailer forms include a first face of a first panel and a first face of a fourth panel that represent respective first and second sides of the return postcard when the form is folded and the first and fourth panels are adhered together. A second side or face of the first and fourth panels include first adhesive portions that receive adhesive to adhere the first panel to the fourth panel to form a reply postcard when the form is folded along a first fold line. At least one of a first face of a first panel and/or a first face of a second panel includes second adhesive patterns or portions that receive adhesive to adhere the first and second panels together as an outgoing mailer. The first and fourth panels include reply card indicia, the third panel includes addressee indicia, and the second panel may include, for example, instructions, advertisement information or any other information, though the order and contents of the panels may be changed. When the form is folded as an outgoing mailer, the second panel is disposed between the first panel and the third panel.

A portion of at least one of the first panel or the second panel includes a third adhesive portion, apart or separate from the first and second adhesive portions. The third adhesive portion defines a confidential pocket or area in which confidential information may be included. The third adhesive portion couples the first and second panels so that the information contained in the confidential pocket or area is not viewable when the form is folded as an outgoing mailer. As the illustrated examples show, this third adhesive pattern on the first face of the first and/or second panels may be omitted and the confidential box may be defined by the second adhesive pattern.

A form configuration with a confidential box or area advantageously enables a user to provide personalized data or other confidential information to a particular recipient via the postcard and/or the confidential pocket or area as noted above, thereby maintaining the secrecy of such information.

Figure 2:
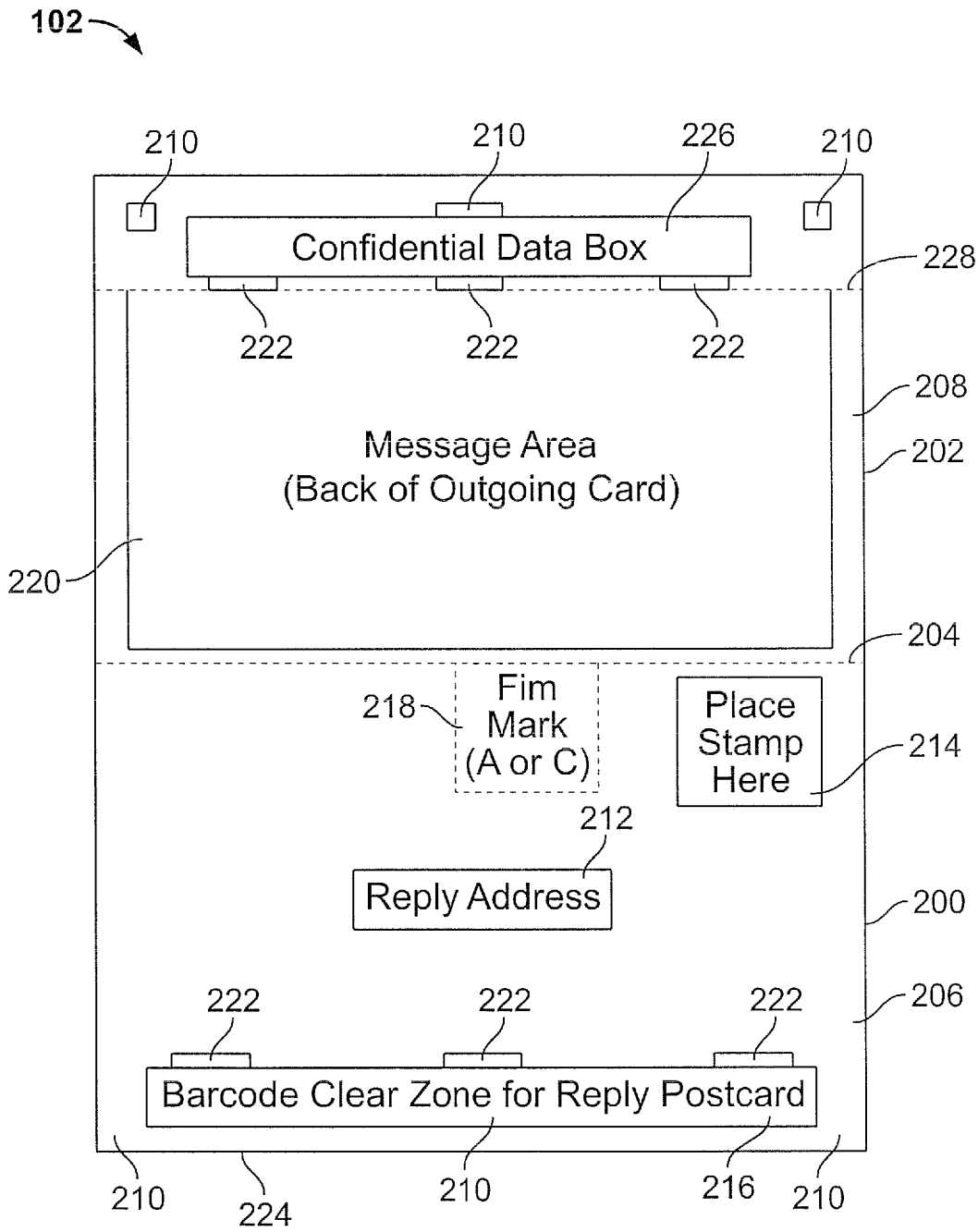
FIG. 2 is a plan view of one of the example postcard forms of FIG. 1 separated from the example substrate.

FIG. 1 is a plan view of an example substrate 100 including two side-by-side two-way postcard constructions 102 and 104. The first postcard construction 102 and the second postcard construction 104 are constructed in similar manners and may include information that is identical, similar, personalized and/or otherwise disparate. The first postcard construction 102 and the second postcard construction 104 may be decoupled by cutting along a mid-line 106, which may be, for example, a perforation, a fold, other line of weakness or a line half-way through the substrate 100 that has not been weakened until a cut is made to separate the two constructions 102 and 104. In the interest of brevity only the first postcard construction 102, which is shown in FIG. 2, will be described in more detail.

The example postcard construction 102 includes a first panel 200 and a second panel 202. The first panel 200 and the second panel 202 are separated by a fold line 204 or other line of weakness. To form the outgoing mailer (i.e., the outgoing postcard), the first panel 200 and second panel 202 are folded in a V-fold about the fold line 204 so that a first face 206 of the first panel 200 is opposite and coupled to a first face 208 of the second panel 200. At least one of the first face 206 of the first panel 200 and/or the first face 208 of the second panel 202 includes a first adhesive pattern 210 to releasably couple the first panel 200 and the second panel 202. In this example, the first adhesive pattern 210 is shown as a series of distinct adhesive spots. However, any other suitable pattern may be used as well including solid strips or lines, series of dots, etc.

Figure 3:
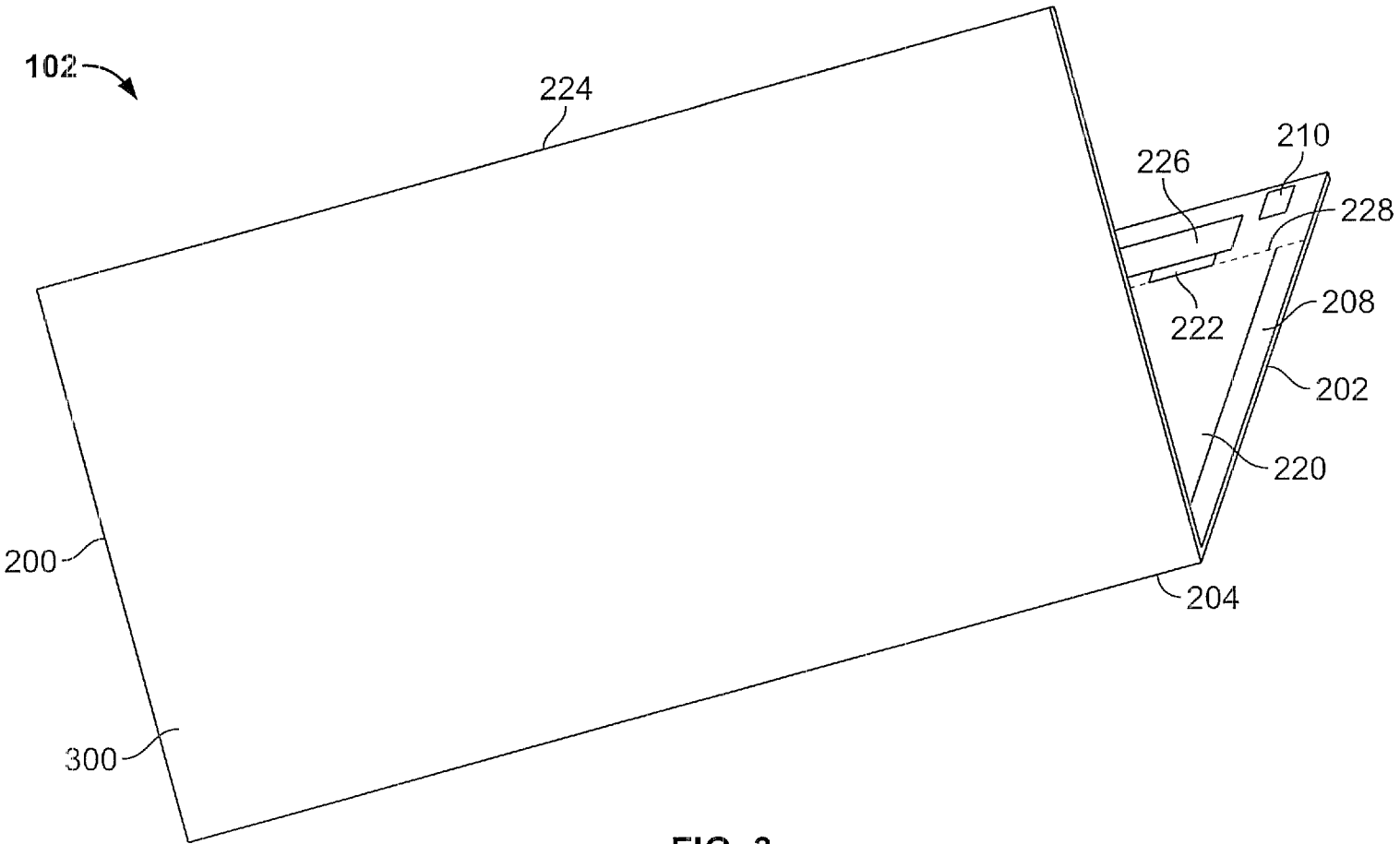
FIG. 3 illustrates the example postcard form of FIG. 2 folded about a first fold line.

In this example, the first panel 200 forms a reply postcard that may be detached from the second panel 202 and used by the recipient of the postcard construction 102 to respond to an offer, for example. The first face 206 of the first panel 200 includes the face of the reply card and, thus, may include addressee indicia 212, a stamp area 214, a barcode area 216 for post office barcoding, and an area for face identification marks (FIM) 218, etc. A second face 300 (FIG. 3) of the first panel 200 serves as the back of the reply card and the back of the outgoing mailer and may include various desired and/or appropriate indicia.

Figure 7:
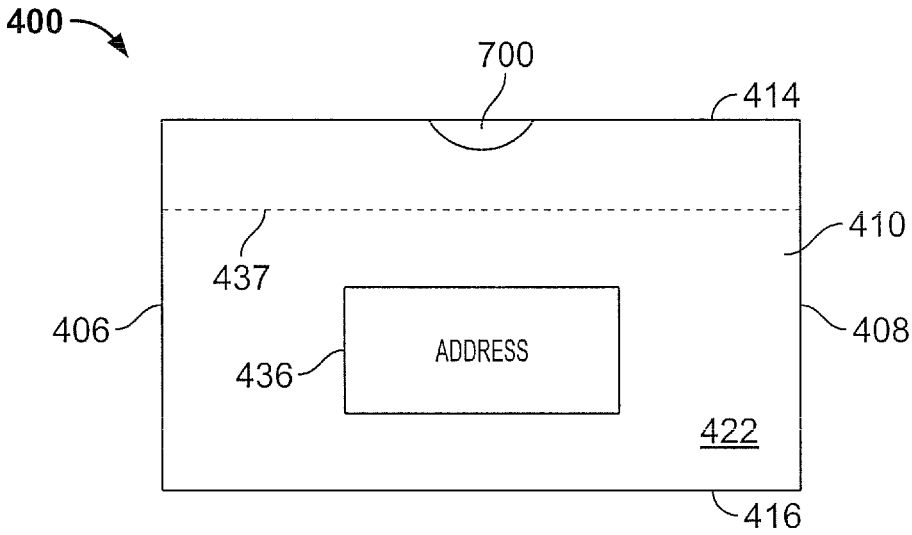
FIG. 7 is a plan view of an example double postcard formed from the example substrate of FIG. 4.

The second panel 202 forms the portion of the outgoing mailer that provides the recipient with the intended information in a message area 220 on the first face 208 of the second panel 202. A second face (not shown) of the second panel 202 forms the front face of the outgoing mailer and, therefore, include address indicia for the recipient/addressee. An example front face of an outgoing postcard mailer is shown in FIG. 7.

At least one of the first face 206 of the first panel 200 and/or the first face 208 of the second panel 202 includes a second adhesive pattern 222, which is set apart or is separate from the first adhesive pattern 210. In this example, the second adhesive pattern 222 is shown as a series of distinct adhesive spots. However, any other suitable pattern may be used as well including solid strips or lines, series of dots, etc. On the first panel 200, the first adhesive pattern 210 and the second adhesive pattern 222 define the barcode area 216, without interfering, in terms of either printing or readability, with any barcode contained therein. In some examples, the barcode area 216 is a 0.625 inch wide rectangle that starts at a bottom edge 224 of the first panel or reply card 200 and continues up to 0.625 inches from the bottom edge 224. However, in other examples, other shapes and dimensions may be used instead or in addition to those recited here.

On the second panel 202, the first adhesive pattern 210 and the second adhesive pattern 222 define a confidential pocket, box or area 226. In the confidential area 226, personal and/or confidential information may be printed. When the postcard construction 102 is formed as an outgoing mailer, the sides of the mailer are left unadhered, as required by the USPS, and a postal inspector, employee or other person can look into the outgoing mailer and read the information shown on the first face 206 of the first panel 200 and the first face 208 of the second panel 202, outside of the confidential area 226 because the first adhesive pattern 210 and the second adhesive pattern 222 ensure the confidential area 226 remains covered.

Though the first adhesive pattern 210 and the second adhesive pattern 222 are described as separate adhesive patterns, these adhesive patterns maybe be contiguous, coincide, flow together or otherwise combined into one adhesive pattern that provides an area that remains sealed from view when the form is folded as an outgoing mailer.

The form 100 may also include a perforation or other line of weakness 228 through most or all of the second panel 202. The perforation 228 separates the confidential area 226 from the remainder of the second panel 202. The perforation 228 may be manipulated by the recipient, for example, to remove the confidential area 226 and, thus, the sensitive information contained therein, from the remainder of the postcard construction 102.

Figure 4:
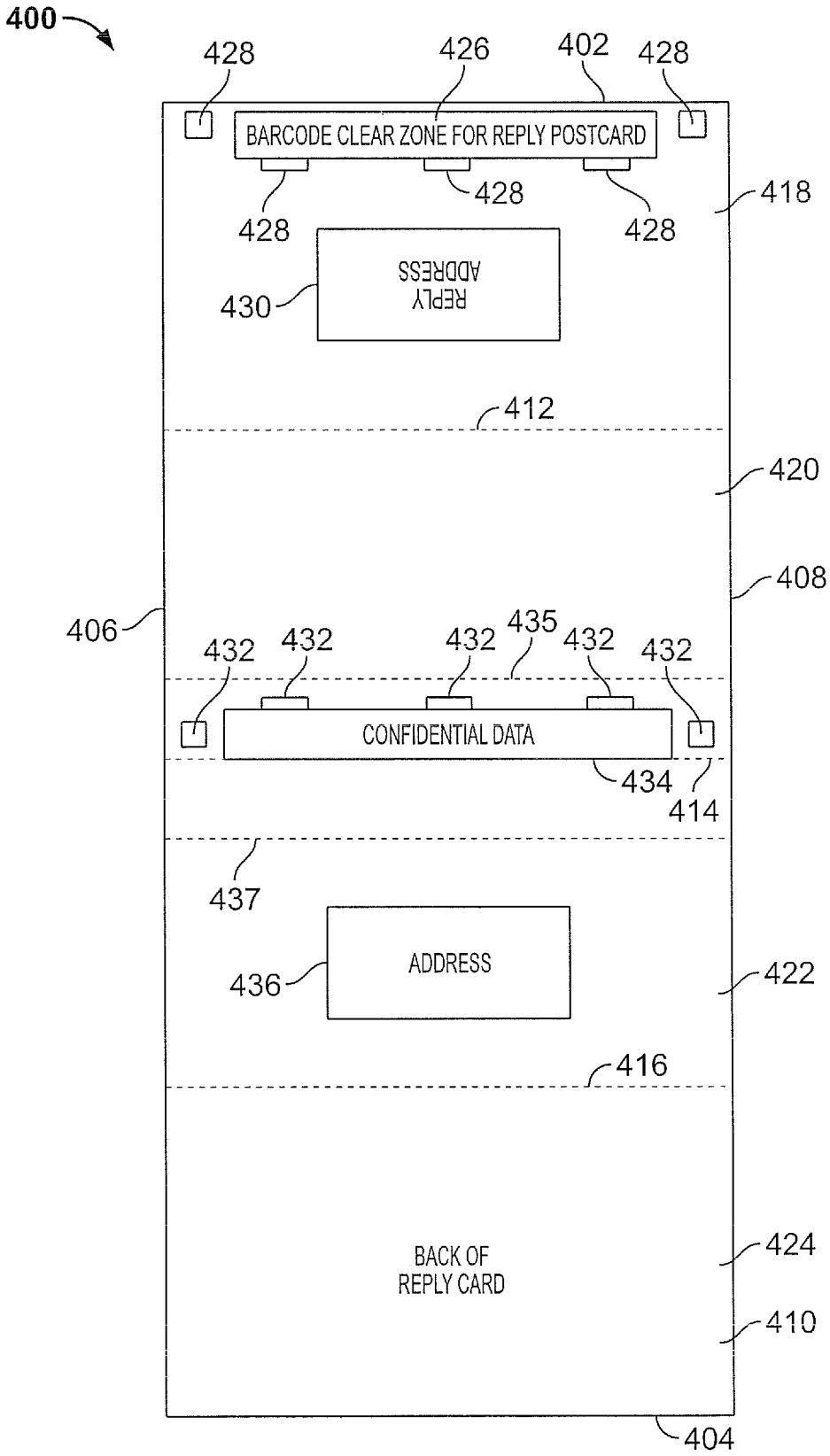
FIG. 4 is a plan view of another example substrate used to form an example double V-fold double postcard.

FIG. 4 illustrates an alternative example postcard construction or form 400 that folds into an outgoing mailer through a double V-fold. The example form 400 is made from a single sheet of paper or other substrate. In the example, the form 400 has approximately one half the thickness of a postcard meeting USPS requirements and regulations (e.g., 0.0035 inches thick). In one example, the form 400 is fourteen inches long by six inches wide and is made from a sheet of paper of sufficient weight or thickness so that a postcard separated from an outgoing mailer formed when the form 400 is double parallel folded can be properly handled by automated postal sorting equipment. In other examples, the form 400 may have any other suitable dimensions or sizes.

The example form 400 includes top and bottom edges 402 and 404, respectively, and parallel first and second side edges 406 and 408, respectively. In this example, the top and bottom edges 402 and 404 are substantially perpendicular to the side edges 406 and 408. The form 400 further defines a front face or first side 410 (FIG. 4) and a back face or second side 500 (as partially seen in FIG. 5).

The example form 400 includes first, second and third lines of weakness or fold lines 412, 414 and 416. The example fold lines 412, 414 and 416 are substantially parallel to the top and bottom edges 402 and 404 and extend substantially transverse to, and at least partially between the side edges 406 and 408 to divide the form 400 into four panels 418, 420, 422 and 424. The first panel 418 is the top panel of the example form 400, the second panel 420 is the second panel of the example form 400, the third panel 422 is the third panel of the example form 400 so that the second panel 420 is between the first panel 418 and the third panel 422, and the fourth panel 424 is the bottom panel of the example form 400 so that the third panel 420 is between the second panel 420 and the fourth panel 424.

The example lines of weakness or fold lines 412, 414 and 416 may be any suitable type including, for instance, perforation lines, die cut lines, scores or creases, etc., to facilitate folding of the example form 400 and/or removal of the panels 418, 420, 422 and/or 424 by an end user or recipient of the form 400.

In this example, the first, second and third fold lines 412, 414 and 416 extend substantially the entire distance between the first and second side edges 406 and 408 and each of the fold lines 412, 414 and 416 is substantially continuously formed. In other examples, at least one of the first, the second, or the third fold lines 412, 414 and 416 may extend less than the entire distance between the first and second side edges 406 and 408 and/or may be formed by two or more collinear fold lines. For example, the fold lines 412, 414 and 416 may be discontinuously formed. Thus, the first, second, third, and fourth panels 418, 420, 422 and 424 in combination define the form 400 prior to folding as an outgoing mailer as described below. The first panel 418 is interconnected with the second panel 420 via the first fold line 412, the second panel 420 is interconnected with the third panel 422 via the second fold line 414, and the third panel 422 is interconnected with the fourth panel 420 via the third fold line 416. The first, second, third and fourth panels 418, 420, 422 and 424 are interconnected in a manner that enables the first, second, third, and fourth panels 418, 420, 422 and 424 to be double parallel folded onto each other as explained in greater detail below.

The first, second, third, and/or fourth panels 418, 420, 422 and 424 may include human and/or machine readable indicia that may be pre-printed on the example form 400, printed when the form 400 is passed through a printer such as, for example, a laser printer, handwritten on the form 400, provided via a label, and/or any combination thereof. Additionally or alternatively, the first, second, third, and/or fourth panels 418, 420, 422 and 424 may include personalized information relating to a particular recipient/customer of the example form 400 and/or any other suitable information. In some examples, each of the first, second, third and/or fourth panels 418, 420, 422 and 424 may be left blank. Furthermore, in this example, the second panel 420 may include confidential information and, as explained in detail below, a portion of the second panel 420 is sealed when folded as the example outgoing mailer, thereby assuring confidentially and show-through protection for information on the second panel 420.

In this example, the first side 410 of the first panel 418 includes a barcode area 426 that may include a barcode or in which the USPS may print a barcode or other routing and/or processing information. The first side 410 of the first panel 418 also includes a first pattern of adhesive 428, which, in the illustrated example, outlines or surrounds the barcode area 426. In other examples, the first adhesive pattern 428 may be disposed on a different area of the first panel 418 or on a different one of the panels 418, 420, 422 and/or 424. Furthermore, though the first adhesive pattern 428 is shown as a series of spots, any type of pattern including, for example, solid strips, dots, etc. may be used instead of or in addition to the series of spots. The first side 410 of the first panel 418 also includes a first addressing area 430 that may be used, for example, for addressing information for the addressee of a reply card.

The first face 410 of the second panel 420 includes a second adhesive pattern 432 in addition to or as an alternative to the first adhesive pattern 428. In other examples, the second adhesive pattern 432 may be disposed on a different area of the second panel 420 or on a different panel. Furthermore, though the second adhesive pattern 432 is shown as a series of spots, any type of pattern including, for example, solid strips, dots, etc. may be used instead of or in addition to the series of spots. The second adhesive pattern 432 defines a confidential pocket, box or area 434, which may be used to contain personalized, confidential or otherwise sensitive information. As described in further detail below, when the form 400 is folded as an outgoing mailer, the first adhesive pattern 428 and/or the second adhesive pattern 432 couple the first face 410 of the first panel 418 and the first face 410 of the second panel 420 such that the confidential area 434 is not exposed and is not exposable by postal employees or anyone else without compromising the bond between the first sides 410 of the panels 418 and 420 created by the first adhesive pattern 428 and/or the second adhesive pattern. 432. In some examples, the second panel 420 also may include a first perforation 435 or other line of weakness. The first perforation 435 may be manipulated by the recipient of the form 400 to remove the confidential area 434 from the form 400.

In this example, the first side 410 of the third panel 422 includes an area 436 for address information of the addressee of the outgoing mailer. The first face 410 of the third panel 422 may also include a stamp area and other areas containing postal information (e.g., return addresses, FIMs, etc.) as desired. In addition, the third panel 422 may include a second perforation or other line of weakness 437. The second perforation 437 aligns with the first perforation 435 when the form 400 is folded about the second fold line 414 as described below. When the second panel 420 and the third panel 422 are coupled as detailed below, the second perforation 437 facilitates manipulation of the first perforation 435 to remove the confidential area 434.

The first face 410 of the fourth panel 424 forms the back of the reply card and may contain any desired and/or appropriate information. In some examples, the fourth panel is left blank.

Figure 5:
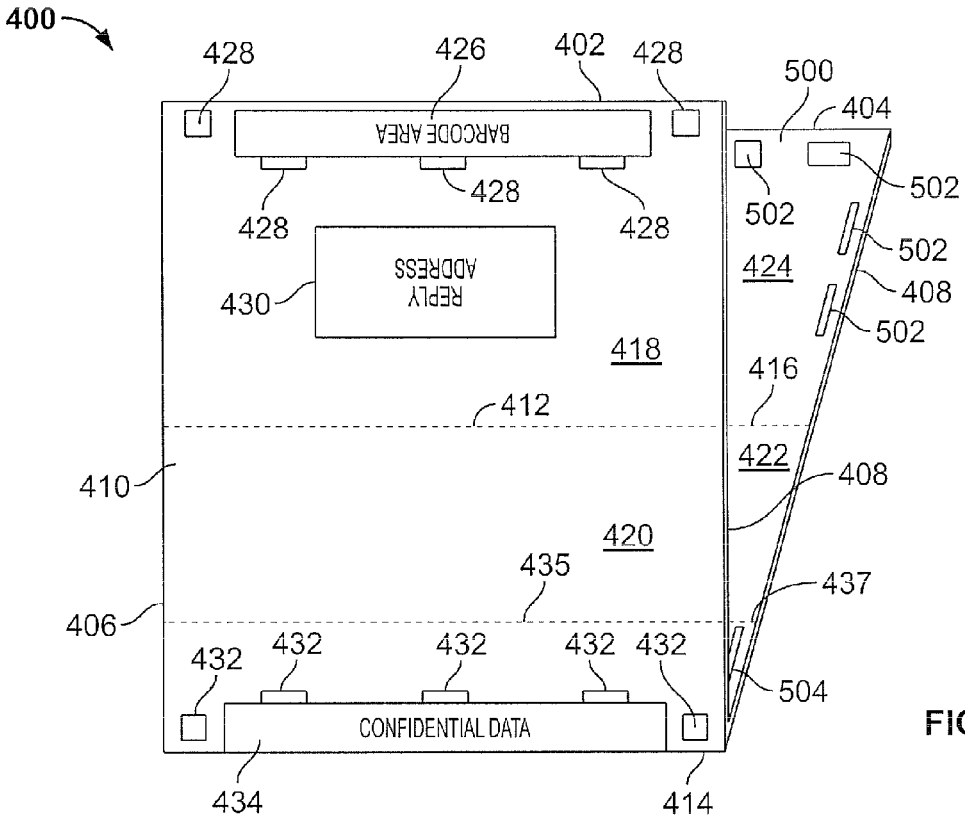
FIG. 5 illustrates the example substrate of FIG. 4 folded about a first fold line.

To fold the form 400 into an outgoing mailer, the form 400 is first folded, as shown in FIG. 5 about the second fold line 414 so that the top edge 402 and the bottom edge 404 align. As shown, when the example form 400 is folded about the second fold line 414, a third adhesive pattern 502 on the second face 500 of the fourth panel 424 couples the second face 500 of the fourth panel 424 to the second face 500 of the first panel 418. Portions of the third adhesive pattern 502 may extend near the sides 406 and 408 and/or near the third fold line 416 to secure the first panel 418 and the fourth 424 along substantially the entire perimeter to for the reply postcard.

A fourth adhesive pattern 504 may also be included on the second face 500 of the third panel 422 to couple the second face 500 of the third panel 422 to the second face 500 of the second panel 420. Though not shown, there may be additionally or alternatively a fifth adhesive pattern and/or a sixth adhesive pattern disposed similar to either of the first, second, third or fourth adhesives patterns 428, 432, 502 and 504 on the second faces 500 of the first panel 418 and/or the second panel 420 for coupling these panels to the fourth panel 424 and third panel 422, respectively.

Figure 6:
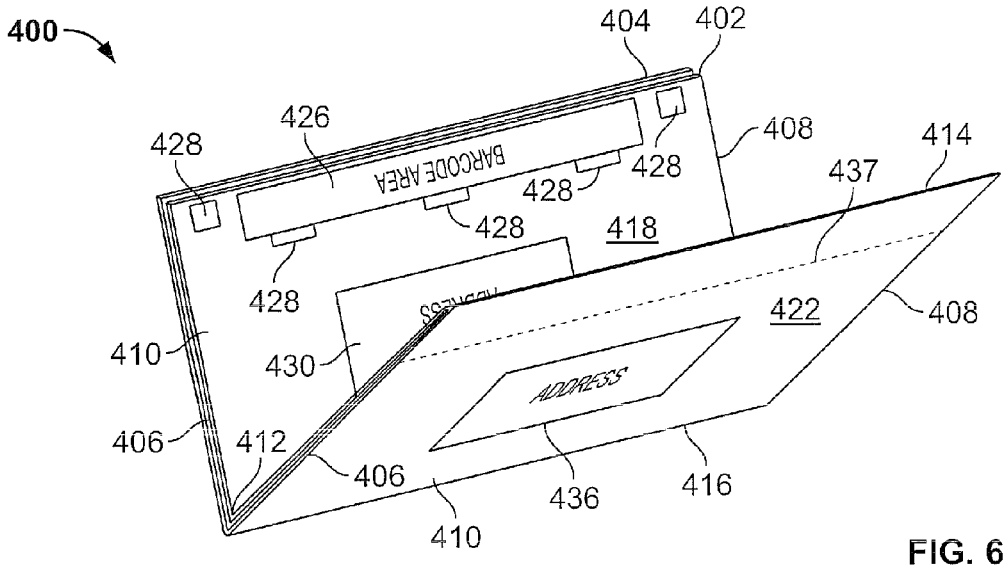
FIG. 6 illustrates the example substrate of FIG. 4 folded about a second fold line.

As shown in FIG. 6, the form 400 is folded along the first fold line 412 and the third fold line 416, which is aligned thereto. When folded along the first fold line 412 and the third fold line 416, the first side 410 of the first panel 418 and the first side 410 of the second panel 420 align and are coupled via one or more of the first adhesive pattern 428 and/or the second adhesive pattern 432. When the first face 410 of the first panel 418 and the first face 410 of the second panel 420 are coupled, the form 400 takes the configuration of an outgoing mailer as shown in FIG. 7. In this configuration of the first face 410 of the third panel 422 and the first face 410 of the fourth panel 424 form the front and back, respectively, of the outgoing mailer 400.

Figure 8:
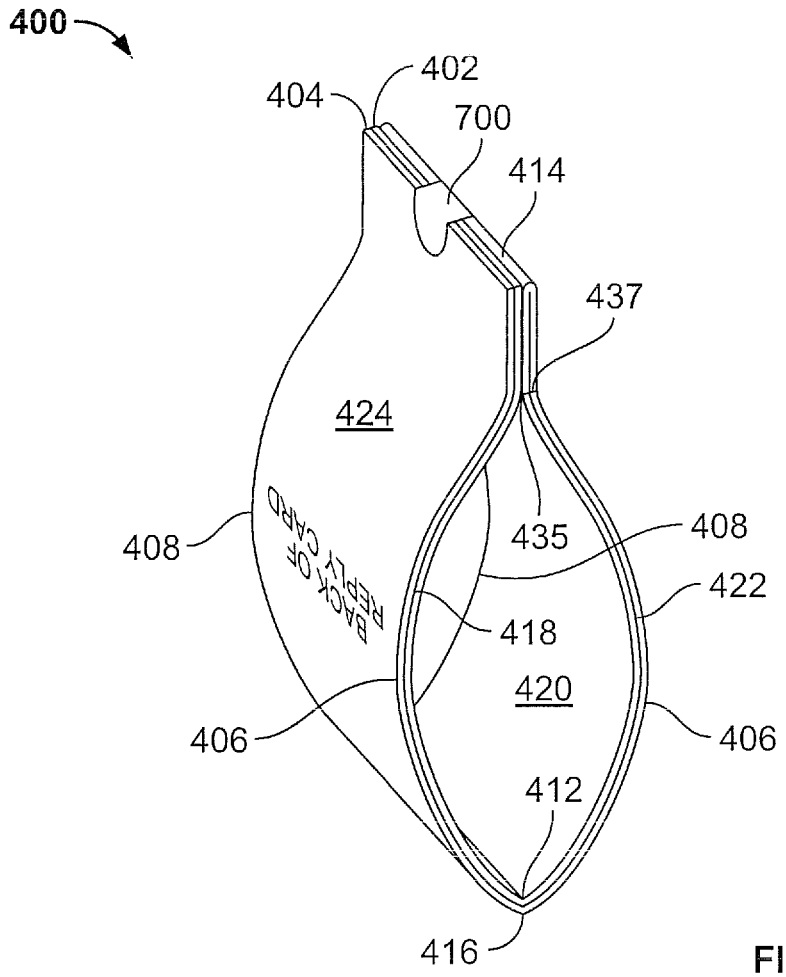
FIG. 8 is another view of the example postcard of FIG. 7 bent open.
Figure 2:
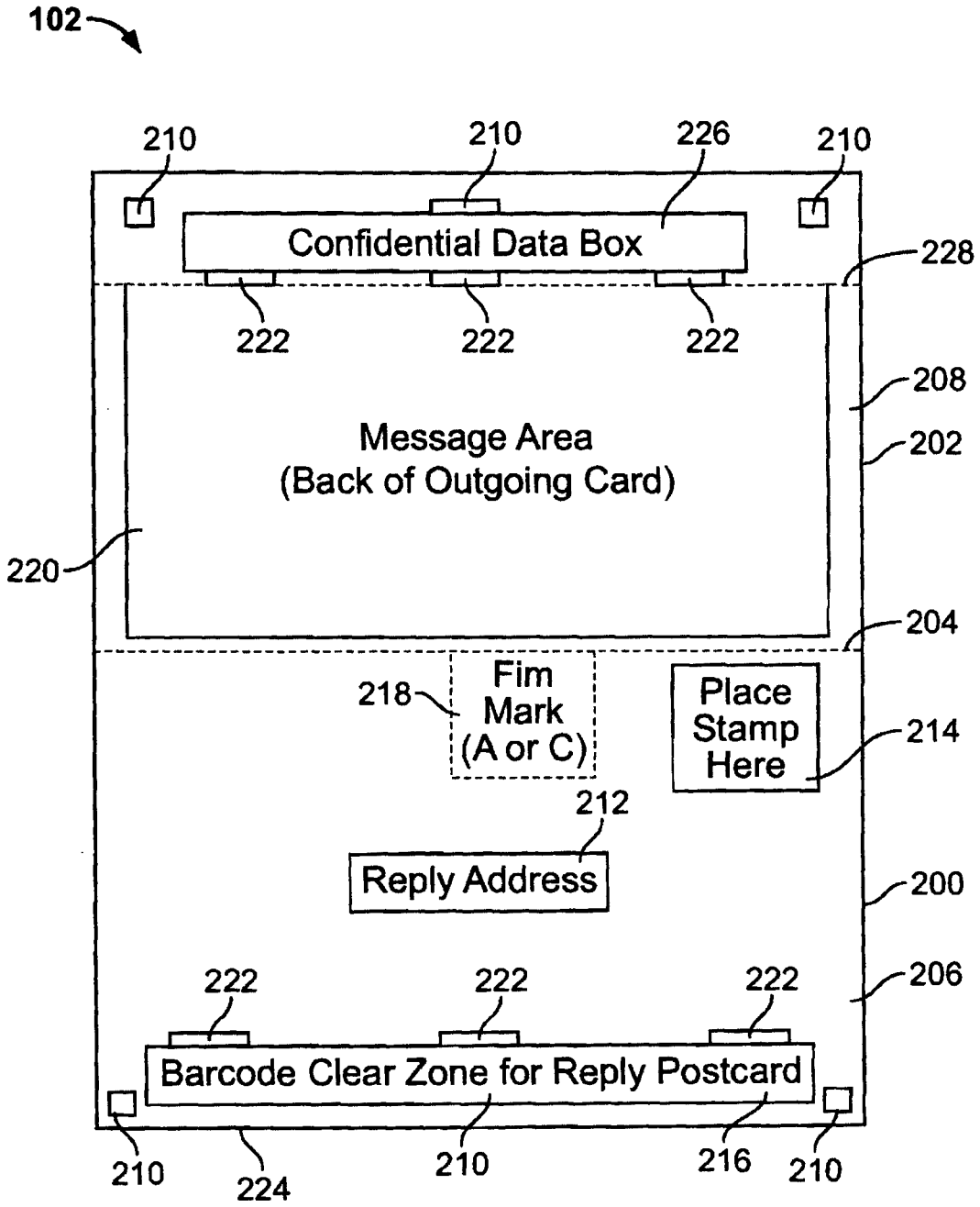

As shown in FIG. 8, when the outgoing mailer 400 is assembled, only a portion of the first face 410 of the second panel 420 and the first face 410 of the first panel 418 are viewable inside the form 400 when the first and fourth panels 418 and 424 bow outward from the second and third panels 420 and 422 (i.e., the top edge 402, bottom edge 404, and second line of weakness or fold line 414 are moved closer to the first and third lines of weakness or fold lines 412 and 416 when the form 400 is folded). The confidential area 434 on the second panel 420 and the corresponding area of the first panel 418 are hidden from view. Thus, the information contained in the confidential area 434 cannot be seen by any postal employee or anyone other than the intended recipient without compromising the adhesive bonds of the first adhesive pattern 428 and/or the second adhesive pattern 432.

To open the form 400, the recipient applies sufficient force to separate the first panel 418 and fourth panel 424 from the second panel 418 and third panel 422 by overcoming the adhesive bond created by the first adhesive pattern 428 and/or the second adhesive pattern 432. The first panel 418 and fourth panel 424, which form the reply card, may be removed by separating these panels from the second panel 420 and the third panel 422 along the first fold line 412 and third fold line 416. In addition, as noted above, the confidential area 434 may be removed by separating the confidential box 434 from the remainder of the second panel 420 along the first perforation 435 and, in some examples, along the second perforation 437 as well.

In some examples, the form 400 may include a security marker 700, which indicates whether the adhesive bond formed by the first adhesive pattern 428 and/or the second adhesive pattern 432 between the first face 410 of the first panel 418 and the first face 410 of the second panel 420 has been broken, tampered with, disengaged, re-engaged or otherwise compromised. In this example, the security marker 700 is a tab (e.g., a label or sticker), that extends over the edge of the form 400 where the top edge 402, the bottom edge 404 and the second fold line 414 meet. If the first panel 418 and second panel 420 are separated so that the confidential area 434 is exposed, the security marker 700 will rip and, thus, provide evidence of the exposure of the confidential area 434. In other examples, the security marker 700 may be a staple or other suitable mechanical or chemical fastener. In addition, there may be a plurality of security markers including, for example, two tabs located over the edge of the outgoing mailer toward each of the left and right sides.

As noted above, the various panels may include any desired and or appropriate human and/or machine readable information or may be left blank. Such information may include, for example, instructional information, receipt information, an advertisement, a coupon, a gift receipt, a gift card, promotional information, a negotiable instrument, a rebate, payor and payee information, headings, titles and/or logos. Additionally or alternatively, the panels may include personalized information tailored specifically for each recipient that is to receive the example mailer 400. Such information may include, for example, a customer name, an item name and model number of a purchased item, a date of purchase, a method of payment, a rebate amount, a date a rebate was paid, and/or any other suitable personalized information.

The reply card (e.g., the first panel 418 and the fourth panel 424) may be a business reply postcard, a courtesy reply postcard and/or any other suitable postcard. The reply card may include a survey, a request for promotional discounts or rebates, a purchase request, extended warranty information, a request for additional information relating to the extended warranty, a request for information or rebate information for various products, truncated credit card information, an authorization signature line to purchase a product or service such as, for example, extended warranty coverage for a purchased item, the recipient's name, address information, other personal information, and/or a section to correct such information if it is incorrect. The reply card may also include return address indicia, address barcode information, postage indicia and/or any other suitable indicia or information.

The confidential area 434 may contain the more sensitive and personal information including, for example, any financial information, a credit card number, a portion of a credit card or account number, a password, an address, a check number, an amount of money, a ticket number, a phone number, a name, a social security number, a portion of a social security number, a code, a test result, an acceptance decision (e.g., to a college), a prescription, a judgment or any other confidential and/or personal information.

The indicia or information on the first, second, third or fourth panels 418, 420, 422 and 424 can be inverted from the orientation shown or printed in any other manner. In this example, the first, second, third and fourth panels 418, 420, 422 and 424 are substantially the same size (e.g., the same width and length). In other examples, the panels 420, 422 and 424 may be any suitable size. In still other examples, the panels 420, 422 and 424 may be configured in any suitable arrangement so that the form 400 may be folded as a Z-fold configuration, a C-fold configuration, and/or any other suitable fold configurations.

The adhesive patterns 210, 222, 428, 432, 502 and 504 described herein are pressure activated adhesives. By utilizing a pressure activated adhesive, the example forms 100 and 400 may be processed through a printer without having the adhesive impair or damage the printer because the rollers of a printer do not apply sufficient pressure to the forms 100 and 400 to activate the adhesive. When folded via, for example, a folding machine, the folded forms 100 and 400 are passed through a roller or other pressure applying devices that apply sufficient pressure to active the adhesive on the adhesive patterns 210, 222, 428, 432, 502 and/or 504 to secure or hold the folded forms 100 and 400 as the example outgoing mailers shown herein. However, in other examples, the adhesive patterns 210, 222, 428, 432, 502 and 504 may include a variety of different adhesives such as, for example, rewettable adhesive, heat activated adhesive, and/or any other suitable adhesive or chemical fastening substance(s).

In addition, in some or more of the illustrated examples, one or more of the adhesive patterns 210, 222, 428, 432, 502 and 504 may be permanent adhesives such as a pressure seal adhesive, cohesive, and/or any other suitable fastening substance. For example, the fourth adhesive pattern 502 forms the reply card upon folding the form 400 and the application of suitable pressure to the fourth adhesive pattern 502. Furthermore, in some examples, the fourth adhesive pattern 502 may be substantially continuous to preclude delamination of the return postcard. The other adhesive patterns 210, 222, 428, 432 and 504 may be continuous as well. However, in other examples, the adhesive patterns 210, 222, 428, 432, 502 and 504 may be provided as a plurality of discontinuous elements (strips, spots, etc.) and/or may be disposed in any suitable pattern, shape, or density.

Any feature of any example described herein may be combined with any other feature of any example described herein. In addition, though V-fold and double V-fold postcards are described herein, the one or more of the features of these examples may be included in any type of postcard, mailer or business form. In addition, the example forms described herein are not limited to the described series and orientations of panels, and may be reversed or changed in any suitable manner.

Although certain example apparatus and articles of manufacture have been described herein, the scope of coverage of this patent is not limited thereto. On the contrary, this patent covers all apparatus and articles of manufacture fairly falling within the scope of the appended claims either literally or under the doctrine of equivalents.

What is claimed is:

1. A postcard mailer comprising:

a substrate comprising a first panel and a second panel adjacent the first panel, wherein each of the first panel and the second panel includes a first face and a second face, the first panel comprises a first edge of the substrate and the second panel comprises a second edge of the substrate opposite the first edge;

a first line of weakness separating the first panel and the second panel;

a first fastener pattern included on at least one of the first face of the first panel or the first face of the second panel to releasably adhere a first portion of the first face of the first panel to a first portion of the first face of the second panel when the substrate is folded about the first line of weakness; and a second fastener pattern included on at least one of the first face of the first panel or the first face of the second panel to releasably adhere a second portion of the first face of the first panel to a second portion of the first face of the second panel, wherein at least a portion of the second fastener pattern and at least a portion of the first fastener pattern define an area that is not visible when the first face of the first panel is releasably adhered to the first face of the second panel and a third portion of the first face of the first panel and a third portion of the second face of the second panel are separated from each other, wherein at least one of the first fastener pattern is adjacent a first lateral edge of the substrate and a second lateral edge of the substrate opposite the first lateral edge, and a first portion of the second fastener pattern is between the first line of weakness and the second edge and a second portion of the second fastener pattern is between the first portion of the second fastener pattern and the second edge, the area is at least partially outlined by the first pattern, the first portion of the second fastener pattern, and the second portion of the second fastener pattern.

2. A postcard mailer as defined in claim 1, wherein the first fastener pattern and the second fastener pattern include one or more of an adhesive, a pressure-sensitive adhesive, a cohesive, a rewettable adhesive, a heat activated adhesive, a releasable adhesive, a mechanical fastener, or a chemical fastener.

3. A postcard mailer as defined in claim 1, wherein the first fastener pattern and the second fastener pattern include one or more of a continuous strip, a plurality of dots, or a plurality of spots.

4. A postcard mailer as defined in claim 1, wherein the first fastener pattern and the second fastener pattern are contiguous.

5. A postcard mailer as defined in claim 1, further comprising a security marker to indicate if at least one of the first fastener pattern or the second fastener pattern has been compromised.

6. A postcard mailer as defined in claim 5, wherein the security marker is one or more of a tab, a label, a sticker, or a staple.

7. A postcard mailer as defined in claim 1, further comprising a second line of weakness located on the first panel between the area and the third portion to enable the area to be removed from the postcard mailer.

8. A postcard mailer as defined in claim 7, wherein the first fastener and the second fastener are between the second line of weakness and the first edge when the first and second panels are releasably adhered.

9. A postcard mailer as defined in claim 7, further comprising a barcode area on the second panel, the bar code area to be between the second line of weakness and the second edge when the first and second panels are releasably adhered, the bar code area to face the area when the first and second panels are releasably adhered.

10. A postcard mailer as defined in claim 1, wherein the area comprises a confidential area at least partially covered by a bar code area of the first or second panels when the first and second panels are releasably adhered, the bar code area to face the confidential area when the first and second panels are releasably adhered.

11. A postcard mailer as defined in claim 10, wherein the area is to receive indicia.

12. A postcard mailer comprising:

a substrate comprising a first end, a second end opposite the first end and a first line of weakness formed between the first end and the second end, where the first line of weakness defines a first panel between the first end and the first line of weakness and a second panel between the second end and the first line of weakness;

a first fastener pattern included on at least one of the first panel or the second panel to releasably adhere a first portion of the first panel to a first portion of the second panel when the substrate is folded about the first line of weakness and the first end is adjacent the second end;

a second line of weakness across the first panel to divide the first panel into a first subpanel and a second subpanel; and a second fastener pattern included on at least one of the first subpanel or the second subpanel to releasably adhere the first subpanel to the second subpanel, wherein the second fastener pattern defines a confidential area that is not visible when the first subpanel is releasably adhered to the second subpanel and the first end and the second end are moved closer to the second line of weakness and the first subpanel and the second subpanel bow outward, wherein the second fastener pattern bounds at least three sides of the confidential area.

13. A postcard mailer as defined in claim 12, wherein the first fastener pattern and the second fastener pattern include one or more of an adhesive, a pressure-sensitive adhesive, a cohesive, a rewettable adhesive, a heat activated adhesive, a releasable adhesive, a mechanical fastener, or a chemical fastener.

14. A postcard mailer as defined in claim 12, wherein the first fastener pattern and the second fastener pattern include one or more of a continuous strip, a plurality of dots, or a plurality of spots.

15. A postcard mailer as defined in claim 12, wherein the first fastener pattern and the second fastener pattern are contiguous.

16. A postcard mailer as defined in claim 12, further comprising a security marker to indicate if one or more of the first fastener pattern or the second fastener pattern has been compromised.

17. A postcard mailer as defined in claim 16, wherein the security marker is one or more of a tab, a label, a sticker, or a staple.

18. A postcard mailer as defined in claim 12, further comprising a third line of weakness located on the first panel between the confidential area and the first line of weakness to enable the confidential area to be removed from the mailer.

19. A postcard mailer as defined in claim 18, wherein second fastener pattern is between the third line of weakness and the first line of weakness when the first and second subpanels are releasably adhered.

20. A postcard mailer as defined in claim 12, wherein the first line of weakness is adjacent the first and second edges when the substrate is folded about the first and second lines of weakness.

21. A postcard mailer comprising:

a substrate having a first face and a second face and comprising a top edge, a bottom edge parallel to the top edge, a first side edge perpendicular to the top edge and a second side edge parallel to the first side edge;

a first line of weakness parallel to the top edge, a second line of weakness parallel to the top edge and a third line of weakness parallel to the top edge;

a first panel defined between the top edge and the first line of weakness;

a second panel defined between the first line of the weakness and the second line of weakness;

a third panel defined between the second line of weakness and the third line of weakness;

a fourth panel defined between the third line of weakness and the bottom edge;

a first fastener pattern comprising a fastener on the second face of at least one of the first panel, the second panel, the third panel or the fourth panel to adhere the first panel and the fourth panel and to adhere the second panel and the third panel when the substrate is folded about the second line of weakness so the second faces of the first panel and second panel are opposite the second faces of the third panel and the fourth panel;

a second fastener pattern comprising a fastener on the first face of at least one of the first panel or the second panel to adhere a first portion of the first panel and a first portion of the second panel when the substrate is folded about the first line of weakness and the third line of weakness so the first face of the first panel is opposite the first face of the second panel; and a third fastener pattern comprising a fastener on at least one of the first panel or the second panel to adhere a second portion of the first panel to a second portion of the second panel, wherein the third fastener pattern and at least a portion of the second fastener pattern define an area that is not visible when the first panel is adhered to the second panel and the top edge, the bottom edge and the second line of weakness are moved closer to the first line of weakness and the third line of weakness and when the first panel and the fourth panel bow outward from the second panel and the third panel, wherein the area is at least partially outlined by (a) at least a portion of the second fastener pattern, (b) at least a portion of the third fastener pattern, and (c) one or more of the second line of weakness or the top edge.

22. A postcard mailer as defined in claim 21, wherein the first fastener pattern, the second fastener pattern and the third fastener pattern include one or more of an adhesive, a pressure-sensitive adhesive, a cohesive, a rewettable adhesive, a heat activated adhesive, a releasable adhesive, a permanent adhesive, a mechanical fastener, or a chemical fastener.

23. A postcard mailer as defined in claim 21, wherein the second fastener pattern and the third fastener pattern are contiguous.

24. A postcard mailer as defined in claim 21, further comprising a security marker to indicate if at least one of the second fastener pattern or the third fastener pattern has been compromised.

25. A postcard mailer as defined in claim 24, wherein the security marker is one or more of a tab, a label, a sticker, or a staple.

26. A postcard mailer as defined in claim 21, further comprising a fourth line of weakness located on the second panel between the area and the first line of weakness and a fifth line of weakness located on the third panel between the second line of weakness and the third line of weakness so that, when the substrate is folded about the second line of weakness, the fourth line of weakness and the fifth line of weakness align and enable the area to be removed from the mailer.

27. A postcard mailer as defined in claim 21, wherein the first fastener pattern comprises a permanent fastener to permanently adhere the first panel and the fourth panel and to permanently adhere the second panel and the third panel, and wherein the second fastener pattern and the third fastener pattern comprise a releasable fastener to releasably adhere the first portion of the first panel and the first portion of the second panel and to releasably adhere the second portion of the first panel to the second portion of the second panel.

* * * * *

UNITED STATES PATENT AND TRADEMARK OFFICE

CERTIFICATE OF CORRECTION

PATENT NO. : 8,579,333 B2
APPLICATION NO. : 12/699700
DATED : November 12, 2013
INVENTOR(S) : Michael Clark Dyer and Mark Anthony Costanzo It is certified that error appears in the above-identified patent and that said Letters Patent is hereby corrected as shown below:

In the drawings,

Delete drawing sheet, and substitute therefor the drawing sheet consisting of FIG. 2, as shown on the attached page.

Signed and Sealed this
Twenty-first Day of April, 2015

Michelle K. Lee

Michelle K. Lee
*Director of the United States Patent and Trademark Office*